US010540950B2

(12) United States Patent
Nurse

(10) Patent No.: US 10,540,950 B2
(45) Date of Patent: Jan. 21, 2020

(54) ELECTROPHONIC CHORDOPHONE SYSTEM, APPARATUS AND METHOD

(71) Applicant: In8Beats Pty Ltd, Piarra Waters (AU)

(72) Inventor: Christopher Andrew Nurse, Piarra Waters (AU)

(73) Assignee: In8Beats Pty Ltd, Piarra Waters (AU)

( * ) Notice: Subject to any disclaimer, the term of this patent is extended or adjusted under 35 U.S.C. 154(b) by 0 days.

(21) Appl. No.: 16/063,246

(22) PCT Filed: Dec. 15, 2016

(86) PCT No.: PCT/AU2016/051239
§ 371 (c)(1),
(2) Date: Jun. 15, 2018

(87) PCT Pub. No.: WO2017/100850
PCT Pub. Date: Jun. 22, 2017

(65) Prior Publication Data

US 2019/0012998 A1 Jan. 10, 2019

(30) Foreign Application Priority Data

Dec. 17, 2015 (AU) ..... 2015905253

(51) Int. Cl.
*G10H 1/38* (2006.01)
*G10H 3/12* (2006.01)
(Continued)

(52) U.S. Cl.
CPC ..... *G10H 1/383* (2013.01); *G10H 3/125* (2013.01); *G10H 3/188* (2013.01); *G10H 7/00* (2013.01);
(Continued)

(58) Field of Classification Search
CPC ..... G10H 1/383; G10H 7/00; G10H 3/125; G10H 3/188; G10H 2210/056;
(Continued)

(56) References Cited

U.S. PATENT DOCUMENTS 5,663,517 A 9/1997 Oppenheim
5,986,201 A * 11/1999 Starr ..... G10H 1/0066 84/464 A
(Continued)

FOREIGN PATENT DOCUMENTS

JP 2001-092449 A 4/2001
JP 2010-266680 A 11/2010

OTHER PUBLICATIONS

Garay, Peter; "International Search Report"; prepared for application No. PCT/AU2016/051239; dated Feb. 21, 2017; 11 pages.
(Continued)

*Primary Examiner* — Jeffrey Donels
(74) *Attorney, Agent, or Firm* — Winstead PC

(57) ABSTRACT

Provided is an electrophonic chordophone system (20) comprising sensor (24) configured to be operatively responsive to respective strings of a guitar (22). The system (20) also includes non-transitory processor-readable storage means (26) which contains first and second user-configurable tonal formats (28) and (30). Also included is processor (32), arranged in signal communication with the sensor (24) and storage means (26), and adapted to associate a melody group of notes producible by the strings with the first tonal format (28) in a one-to-one mapping or direct correlation, and to associate a control group of notes producible by the strings with the second tonal format (30) in a one-to-many mapping or indirect correlation. Also included is a synthesiser (34), arranged in signal communication with the processor (32), and configured to produce both the first and second tonal formats simultaneously in substantial real-time. The first
(Continued)

tonal format (28) is actuatable via the melody group of notes and the second tonal format (30) is dynamically selectable via the control group of notes and also actuatable via the melody group of notes. In this manner, a melody is producible via the first tonal format (28) with a dynamic backing track producible via the second tonal format (30), all using one guitar (22).

20 Claims, 3 Drawing Sheets

(51) Int. Cl.
*G10H 3/18* (2006.01)
*G10H 7/00* (2006.01)

(52) U.S. Cl.
CPC . *G10H 2210/005* (2013.01); *G10H 2210/056* (2013.01); *G10H 2210/555* (2013.01); *G10H 2220/165* (2013.01)

(58) Field of Classification Search
CPC ..... G10H 2210/005; G10H 2210/555; G10H 2220/165
USPC ..... 84/613
See application file for complete search history.

(56) References Cited

U.S. PATENT DOCUMENTS

| | | | | |
|---|---|---|---|---|
| 6,175,070 | B1 * | 1/2001 | Naples | G09B 15/003 84/470 R |
| 6,995,310 | B1 * | 2/2006 | Knapp | G09B 5/065 84/462 |
| 7,309,829 | B1 | 12/2007 | Ludwig | |
| 7,667,126 | B2 | 2/2010 | Shi | |
| 2004/0089131 | A1 | 5/2004 | Georges et al. | |
| 2005/0045027 | A1 | 3/2005 | Celi et al. | |
| 2009/0100991 | A1 * | 4/2009 | Lazovic | G10H 1/0066 84/645 |
| 2013/0025437 | A1 | 1/2013 | Serletic et al. | |
| 2015/0013527 | A1 * | 1/2015 | Buskies | G10H 1/40 84/611 |
| 2015/0013533 | A1 * | 1/2015 | Buskies | G10H 1/0066 84/645 |
| 2015/0143978 | A1 | 5/2015 | Oh et al. | |
| 2015/0221297 | A1 | 8/2015 | Buskies et al. | |

OTHER PUBLICATIONS

"What Is MIDI Guitar?"; Jam Origin; 2018; 8 pages.

* cited by examiner

ELECTROPHONIC CHORDOPHONE SYSTEM, APPARATUS AND METHOD

TECHNICAL FIELD

This invention relates to an electrophonic chordophone system, apparatus and associated computer-implemented electrophonic chordophone method.

BACKGROUND ART

The following discussion of the background art is intended to facilitate an understanding of the present invention only. The discussion is not an acknowledgement or admission that any of the material referred to is or was part of the common general knowledge as at the priority date of the application.

The present invention lies in the field of music, in general. Typically, a music note is essentially one audible frequency, with a scale being a set of frequency intervals that connects one note to the same note of double the initial frequency. A chord occurs when multiple notes or frequencies are played simultaneously, in one or more scales. Such chord progression then produces music. Some common elements of music are pitch, (which governs melody and harmony), rhythm (including concepts such as tempo, meter, and articulation), dynamics (loudness and softness), and the sonic qualities of timbre and texture.

Music has developed over the years as technology has progressed. As a result, representation of generally analog music signals as digital content for binary computer manipulation has been developed.

For example, MIDI (Musical Instrument Digital Interface) is a technical standard that describes a protocol, digital interface and methods of interconnection and allows a wide variety of electronic musical instruments, computers and other related devices to connect and communicate with one another. MIDI was developed so that musical instruments could communicate with each other and so that one instrument can control another. In general, a single MIDI link can carry up to sixteen channels of information, each of which can be routed to a separate device.

Accordingly, MIDI typically carries event messages that specify notation, pitch and velocity, control signals for parameters such as volume, vibrato, audio panning, cues, and clock signals that set and synchronize tempo between multiple devices. These messages are typically transmitted via a MIDI connection, e.g. cable, wireless, etc., to other devices where they control sound generation and other features. This data can also be recorded into a hardware or software device called a sequencer, which can be used to edit the data and to play it back at a later time.

MIDI data files are a means of storing MIDI messages in a standardized and persistent manner, where MIDI messages are stored, and can later be recalled and transmitted to MIDI devices. An example use of a MIDI data file would be where a pop song is stored as a sequence of MIDI messages held in a MIDI data file, whereby recalling the MIDI messages and transmitting them to a musical keyboard would cause said keyboard to play the pop song. MIDI data files are static after creation in that they do not change, evolve or comprise any dynamic elements. MIDI data files can be edited by a user using technologies relevant to MIDI music composition.

Applicant has identified a need in the art for musicians playing guitar, or similarly stringed instruments, who require backing tracks or similar accompaniment whilst playing. Conventionally, solo guitarists seeking automatic backing tracks or accompaniment are limited to using pre-recorded backing tracks, or using looping pedals. Looping pedals provide an ability to overdub repeated recordings of live guitar playing in order to form a layer of sounds. However, use of looping pedals is not practical in the context of mainstream live performances rendered on guitar and is generally limited to use by only the most technical and accomplished of players.

Another approach has seen the use of pre-recorded audio as backing tracks which can be used to digitally encode a musical performance for repeated replay. However, every time a pre-recorded audio file is used it inherently sounds identical. Once a guitarist has used such a backing track several times, its usefulness as a composition tool or source of inspiration diminishes due to its invariant nature. Pre-recorded backing tracks of any kind always deliver the same chords in the same sequence using the same sounds and are of little use as an inspirational platform for one seeking to compose or play ad lib.

Musical composition can happen through flashes of inspiration, or serendipitous errors which may occur during a performance. When playing with a group of performers, a guitarist experiences the group reacting to changes of chord choice, tempo and rhythm. Through such inspiration and errors, or even concerted effort, it is said musicians may play ad lib, creating a previously unrehearsed musical piece.

Pre-recorded backing tracks or stored sequences of MIDI data all limit the artistic ability to play ad lib, due to their invariant nature, causing the same chord and musical structures to be played verbatim each time they are repeated. In light of the above, Applicant is aware of the following prior art.

US2015/0221297 discloses a method substantially constrained to the formation of drum rhythms, based on an analysis of a musical performance. Additionally, the process involves a sequence of intrinsically linked steps, being an analysis of a musical performance is completed and until such analysis is completed the next step of the sequence cannot begin. A subsequent step executes in order to ascertain an accent pattern and until said accent pattern is ascertained the next step of the sequence cannot begin. A further subsequent step executes in order to use said accent pattern as a means to identify a reference pattern and until said reference pattern is identified the next step of the sequence cannot begin. In this manner, a musical accompaniment is generated, however this is not dynamically responsive due to the intrinsic reliance on the step-wise interlocked sequence which must complete in series before said musical accompaniment can be produced. This becomes a static method of creating an invariant loop of rhythmic sounds which will become tiresome to a musician after a short period of time. This prior art method does not create a dynamic musical accompaniment that would be inspiring and responsive to the performance of a musician in real time. At best, it provides novelty value in creating endless static loops formed from a static musical performance, there is no real-time dynamic content after the accompaniment is generated.

Accordingly, US2015/0221297 teaches a method of creating a rhythmic output which does not comprise melodic elements. An example embodiment of US2015/0221297 is demonstrated in the GarageBand app, which in turn exemplifies a core constraint of the prior art, where a musician is required to manually create a backing track in the form of an infinitely repeating musical loop that never varies from what the musician input in the first instance. GarageBand does not create a melodic accompaniment in response to continuously and randomly selected chords performed by a guitar player. Furthermore, GarageBand is so complex that entire books are published to teach novice users how to create the most rudimentary musical backing tracks.

U.S. Pat. No. 7,309,829 describes a system which can generate a different sound for each string of a guitar, and further can generate multiple sounds, which can be seen as timbrel modification. U.S. Pat. No. 7,309,829 is embodied through custom electronics without which no sound will be generated or heard. It requires the creation of complex circuits, adding much complexity, expense and inconvenience of building and interconnecting a multitude of IC's and other circuitry. This prior art system does not generate an accompaniment that would be observed by any musician to be a real-time accompaniment, e.g. would not produce a sound like a rock band from a single performer.

U.S. Pat. No. 5,663,517 discloses a system which has a significant constraint in its reliance on MIDI input and its responsiveness to all notes appearing as input—there is no provision for analogue signal input. Such an arrangement inherently means that if the input stops, then output correspondingly stops. The system also requires a selection of a plethora of MIDI files and operation of multiple complex user interface elements, which can be complex to a novice musician. The system does not comprise the technology necessary to execute the mathematical models (e.g. Fast Fourier Transform) required in determining the multitude of polyphonic pitches and intents inherent in an analogue signal source.

With all three pieces of prior art above, if an input starts, such as a note triggered on a guitar—when such input stops, the respective teachings of the prior art ceases to create any melodic output. US2015/0221297 appear limited to recording an instrument being played, then analysing that recorded passage in order to creatively present a matching drum beat. It roughly seems to describe "play a guitar or keyboard, and we'll take a moment to think up a drum beat". This in no way resembles any real-time ability to create rhythmic and melodic parts in correspondence to a dynamically shifting and unrecorded sequence of chords. U.S. Pat. No. 7,309,829 can simply be described as a foot pedal—allowing a guitar to sound like different instruments, but does not create a multi-part musical arrangement as would be required to emulate a band of musicians.

The Fishman MIDI pickup is one example of many devices in the prior art which produce MIDI messages in response to notes played on a guitar, whereby said MIDI messages can be transmitted to a MIDI keyboard. The conversion of guitar notes to MIDI messages is a concept which is central to the present invention, however, the primary use of any MIDI pickup is to enable a guitarist to emulate another musical instrument, e.g. a synthesiser essentially substituting the tone of a guitar for the tone of another musical instrument, which Applicant believes is not desirable in many musical applications.

As such, Applicant has identified a need in the art for allowing a guitarist to experience a dynamic and responsive backing track, equivalent to playing with a group of musicians, controlled by the notes or chords played on a guitar, whilst also optionally playing melody ad lib, in order to release a guitarist from the constraints experienced by pre-recorded backing tracks and furthermore enable a single guitarist to control an entire band formed from sequenced and synthesized instruments.

Accordingly, the present invention seeks to propose possible improvements, at least in part, in amelioration of the known shortcomings in the art.

SUMMARY OF THE INVENTION

It is to be appreciated that reference in this specification to a 'guitar' generally includes reference to a chordophone, being any musical instrument capable of producing sounds through the vibration of at least one string tensioned between two points on the instrument. As a result, reference to the term 'guitar' should be construed as reference to any multi-stringed chordophone as far as practical.

According to a first aspect of the invention there is provided an electrophonic chordophone system comprising:

a sensor operatively responsive to respective strings of a guitar;

non-transitory processor-readable storage means containing first and second user-configurable tonal formats;

a processor arranged in signal communication with the sensor and storage means, said processor adaptable to:

i) allow a user to associate a melody group of notes producible by the strings with the first tonal format in a one-to-one mapping, and ii) allow the user to associate a control group of notes producible by the strings with the second tonal format in a one-to-many mapping; and a synthesiser arranged in signal communication with the processor, said synthesiser configured to produce both the first and second tonal formats simultaneously in substantial real-time, the first tonal format actuatable via the melody group of notes and the second tonal format dynamically selectable via the control group of notes and actuatable via the melody group of notes, so that a melody is producible via the first tonal format and an independent dynamic backing track comprising multiple timbres is producible via the second tonal format.

Typically, the first tonal format comprises a collection of notes.

It is to be appreciated that the one-to-one mapping generally refers to a direct correlation. Accordingly, it is to be appreciated that such a direct correlation between the melody group of notes and the first tonal format is a correlation in which a large number of melody notes is associated with a large number of first tonal format notes.

Preferably, the second tonal format comprises a collection of chords and/or timbres.

It is to be appreciated that the one-to-many mapping generally refers to an indirect correlation. Accordingly, it is to be appreciated that such an indirect correlation between the control group of notes and the second tonal format is a correlation in which a small number of control notes is generally associated with a large number of second tonal format notes, chords and/or timbres.

In one example, the control group of notes forms a subset of the melody group of notes.

It is further to be appreciated that reference to 'substantial real-time' within this specification is to be understood as meaning an instance of time which may include a delay typically resulting from processing and/or transmission times inherent in processing systems or communication signal transmissions. These processing and transmission times, albeit of generally short duration, can introduce some delay, i.e. typically milli- or microseconds, but the tonal formats are generally produced with a human-imperceptible delay between string actuation and synthesiser reproduction, i.e. within 'substantial real-time'.

Typically, the sensor may comprise a transducer configured to capture mechanical vibrations from the strings and convert same to an electrical signal.

In one example, the sensor may be configured to digitise analog notes produced by the strings.

Alternatively, the processor may be configured to digitise analog notes produced by the strings.

In one example, the first and second tonal formats may be user-configurable by means of a software application executed by the processor.

It is to be appreciated that the notes comprising the melody group of notes are generally user-configurable. Similarly, the notes comprising the control group of notes are generally user-configurable.

Typically, the melody group of notes is user-configurable. Similarly, the control group of notes is typically user-configurable.

In one example, the melody group of notes and the control group of notes may be user-configurable by means of a software application executed by the processor.

In one example, the processor may be adapted to associate the melody group of notes producible by the strings with the first tonal format in a direct correlation by means of a software application executed by the processor.

In one example, the processor may be adapted to associate the control group of notes producible by the strings with the second tonal format in an indirect correlation by means of a software application executed by the processor.

Typically, the synthesiser comprises an electronic musical instrument that converts electric signals to sound.

In one example, the synthesiser may include at least one speaker.

According to a second aspect of the invention there is provided an electrophonic chordophone apparatus comprising:

an input for receiving notes produced by strings of a guitar;

non-transitory processor-readable storage means containing first and second user-configurable tonal formats;

a processor arranged in signal communication with the input and storage means; and an output whereby the processor is able to output signals to a synthesiser;

wherein the processor is adapted to:

(i) associate a melody group of notes producible by the strings with the first tonal format in a one-to-one mapping, (ii) associate a control group of notes producible by the strings with the second tonal format in an one-to-many mapping, and (iii) output, to the synthesiser, both the first and second tonal formats simultaneously in substantial real-time, the first tonal format actuatable via the melody group of notes and the second tonal format dynamically selectable via the control group of notes and actuatable via the melody group of notes, so that a melody is producible by the synthesiser via the first tonal format and a dynamic backing track comprising multiple timbres is producible via the second tonal format.

In one example, the input may include a transducer configured to capture mechanical vibrations from the strings and convert same to an electrical signal.

In one example, the input may be configured to digitise analog notes produced by the strings.

Alternatively, the processor may be configured to digitise analog notes produced by the strings.

It is to be appreciated that the control group of notes may form a subset of the melody group of notes.

In one example, the first and second tonal formats may be user-configurable by means of a software application executed by the processor.

It is to be appreciated that the notes comprising the melody group of notes are generally user-configurable. Similarly, the notes comprising the control group of notes are generally user-configurable.

Typically, the melody group of notes is user-configurable. Similarly, the control group of notes is typically user-configurable.

In one example, the melody group of notes and the control group of notes may be user-configurable by means of a software application executed by the processor.

In one example, the processor may be adapted to associate the melody group of notes producible by the strings with the first tonal format in a one-to-one mapping by means of a software application executed by the processor.

In one example, the processor may be adapted to associate the control group of notes producible by the strings with the second tonal format in a one-to-many mapping by means of a software application executed by the processor.

According to a third aspect of the invention there is provided a computer-implemented electrophonic chordophone method comprising the steps of:

sensing respective strings of a guitar;

associating a melody group of notes producible by the strings with a first tonal format in a one-to-one mapping;

associating a control group of notes producible by the strings with a second tonal format in a one-to-many mapping; and in response to actuation of the strings, synthesising both the first and second tonal formats simultaneously in substantial real-time, the first tonal format actuatable via the melody group of notes and the second tonal format dynamically selectable via the control group of notes and actuatable via the melody group of notes, so that a melody is produced via the first tonal format and a dynamic backing track comprising multiple timbres is producible via the second tonal format.

Typically, the step of sensing is performed by means of a transducer configured to capture mechanical vibrations from the strings and convert same to an electrical signal.

Typically, both steps of associating the melody group and control group are performed by means of a processor executing a software application.

It is to be appreciated that the control group of notes may form a subset of the melody group of notes.

Typically, the step of synthesising is performed by means of a synthesiser.

Typically, the first tonal format comprises a collection of notes.

Preferably, the second tonal format comprises a collection of chords and/or timbres.

BRIEF DESCRIPTION OF THE DRAWINGS

Further features of the present invention are more fully described in the following description of several non-limiting embodiments thereof. This description is included solely for the purposes of exemplifying the present invention. It should not be understood as a restriction on the broad summary, disclosure or description of the invention as set out above. The description will be made with reference to the accompanying drawings in which.

In the figures, incorporated to illustrate features of an example embodiment or embodiments, like reference numerals are used to identify like parts throughout the figures.

DETAILED DESCRIPTION OF EMBODIMENTS

The following modes, given by way of example only, are described in order to provide a more precise understanding of the subject matter of a preferred embodiment or embodiments.

Figure 1:
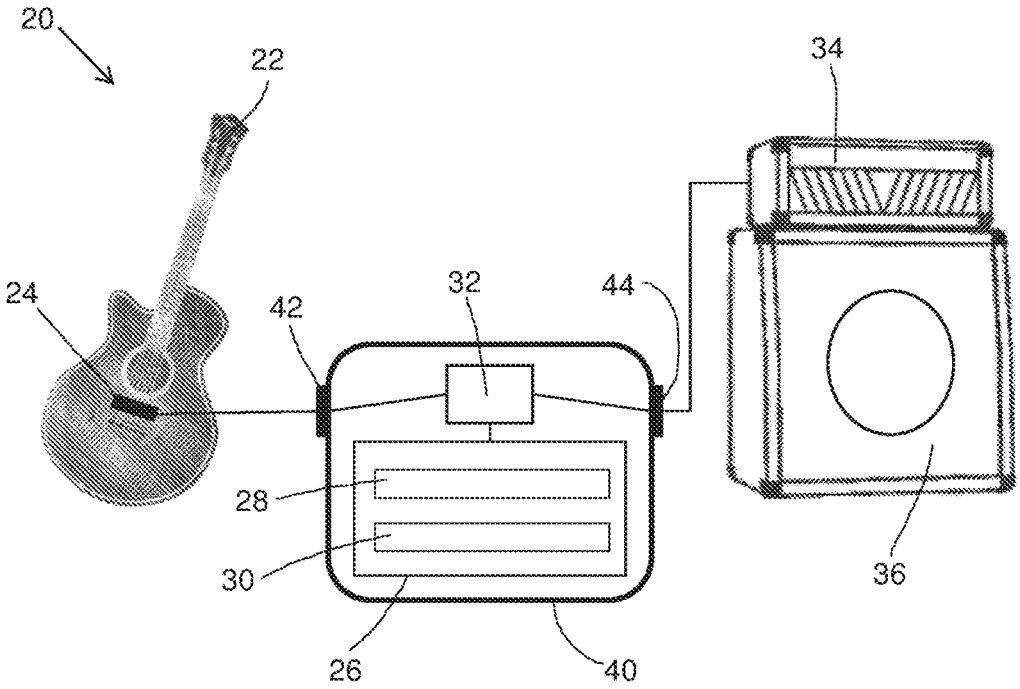
FIG. 1 is a diagrammatic representation of an electrophonic chordophone system and associated apparatus, in accordance with one aspect of the invention.

With reference now to FIG. 1 of the accompanying drawings, there is shown one example of an electrophonic chordophone system 20. The system 20 generally comprises a sensor 24 which has been configured to be operatively responsive to respective strings of a guitar 22.

The sensor 24 generally comprises a transducer which is configured to capture mechanical vibrations from the strings of the guitar 22 and convert such signals to an electrical signal, such as a MIDI signal, or the like. As a result, the sensor 24 may include a pickup, a microphone, and/or the like.

In one example, the sensor 24 may be configured to digitise analogue notes produced by the strings. In another example, a processor 32 of the system 20 may be configured to digitise analogue notes produced by the strings.

The system 20 also includes non-transitory processor-readable storage means 26 which contains first and second user-configurable tonal formats 28 and 30, respectively. Also included in system 20 is processor 32 arranged in signal communication with the sensor 24 and storage means 26.

The processor 32 is generally adapted to associate a melody group of notes producible by the strings with the first tonal format 28 in a one-to-one mapping or direct correlation, and to associate a control group of notes producible by the strings with the second tonal format 30 in a one-to-many mapping or indirect correlation.

In addition, the system 22 generally includes a synthesiser 34 arranged in signal communication with the processor 32, as shown. The synthesiser 34 is, in turn, configured to produce both the first and second tonal formats 28 and 30 simultaneously in substantial real-time. The first tonal format 28 is actuatable via the melody group of notes and the second tonal format 30 is dynamically selectable via the control group of notes and also typically actuatable via the melody group of notes. In this manner, a melody is producible via the first tonal format 28 with a dynamic backing track producible via the second tonal format 30, all using one guitar 22.

The first tonal format 28 typically comprises a collection of distinct notes. Accordingly, it is to be appreciated that the direct correlation between the melody group of notes and the first tonal format 28 is typically a 1:1 mapping or correlation, i.e. one melody group note produces one tonal format note.

However, as will be appreciated by the skilled addressee, the first tonal format 28, as correlated with the melody group notes, typically alters or changes the 'sound' of the melody group notes. For example, instead of an acoustic guitar 'sound' produced by plucking a string on the guitar 22, the first tonal format 28 directs the system 20 to change the sound produced by such plucking to a note produced by another instrument, or a distorted note typically produced by an electric guitar, and/or the like. Such functionality of a direct correlation between string pluck and resulting sound is known in the art of musical synthesisers.

In contrast, the second tonal format 30 typically comprises a collection of chords, chord progressions, and/or timbres. Accordingly, it is to be appreciated that the one-to-many mapping or indirect correlation between the control group of notes and the second tonal format 30 generally results in a single control group note selecting or activating various second tonal format notes, chords, chord progressions, timbres, etc. In addition, the reproduction of such various second tonal format notes, once selected or activated by the control group notes, is actuated by the melody group notes.

In effect, this arrangement enables a guitarist to dynamically control an entire band formed from synthesized instruments at the same time as playing his/her own guitar.

The first and second tonal formats 28 and 30 are generally user-configurable by means of a software application executed by the processor 32. Similarly, the notes comprising the melody group of notes along with the notes comprising the control group of notes are generally user-configurable. Typically, the melody group of notes and the control group of notes are user-configurable by means of a software application executed by the processor 32.

Such user-configurability allows a user to select which notes form part of the melody group and which notes part of the control group. Similarly, the notes, chords, chord progressions, timbres, rhythms, melodies, and other sound characteristics forming the first and second tonal formats 28 and 30 can be pre-selected by a user to allowing an infinite number of musical compositions or arrangements to be formed.

It is to be appreciated that the control group of notes may form a subset of the melody group of notes. For example, a user such as a guitarist, may configure a particular note of a melody or song which starts a chorus of such song as a control group note (which is also a melody group note), so that the second tonal format enlivens or amplifies the chorus as backing whilst the melody or song is played via the first tonal format.

It is also to be appreciated that, one example, the user may decide not to assign or select any notes for the melody group of notes and only assign the control group of notes, such that the first tonal format essentially comprises a null-value. This arrangement allows a melody to be reproducible via only the control group of notes, which may be desirable in certain circumstances.

The synthesiser 34 generally comprises any electronic musical instrument that is able to convert electric signals to sound. Typically, the synthesiser 34 includes at least one speaker 36, as shown, via which the sound is broadcast.

The present invention also provides for an associated electrophonic chordophone apparatus 40. This apparatus 40 generally comprises an input 42 for receiving notes produced by strings of the guitar 22, as well as the non-transitory processor-readable storage means 26 which contains the first and second user-configurable tonal formats 28 and 30.

Apparatus 40 further includes the processor 32 arranged in signal communication with the input and storage means, along with an output 44 via which the processor 32 is able to output signals to the synthesiser 34.

In general, the processor 32 is adapted to (i) associate the melody group of notes producible by the strings with the first tonal format 28 in a direct correlation, (ii) associate the control group of notes producible by the strings with the second tonal format 30 in an indirect correlation, and (iii) output, to the synthesiser 34, both the first and second tonal formats 28 and 30 simultaneously in substantial real-time. Such adaptation is typically achieved via a suitable software application.

As before, the first tonal format 28 is actuatable via the melody group of notes and the second tonal format 30 is dynamically selectable via the control group of notes and, once so selected, also actuatable via the melody group of notes. In this manner, a melody is producible by the synthesiser 34 via the first tonal format 28, and a dynamic backing track via the second tonal format 30.

Typically, the melody group of notes, the control group of notes, the first tonal format 28 and the second tonal format 30 are user-configurable by means of a software application executed by the processor 32.

Figure 2:
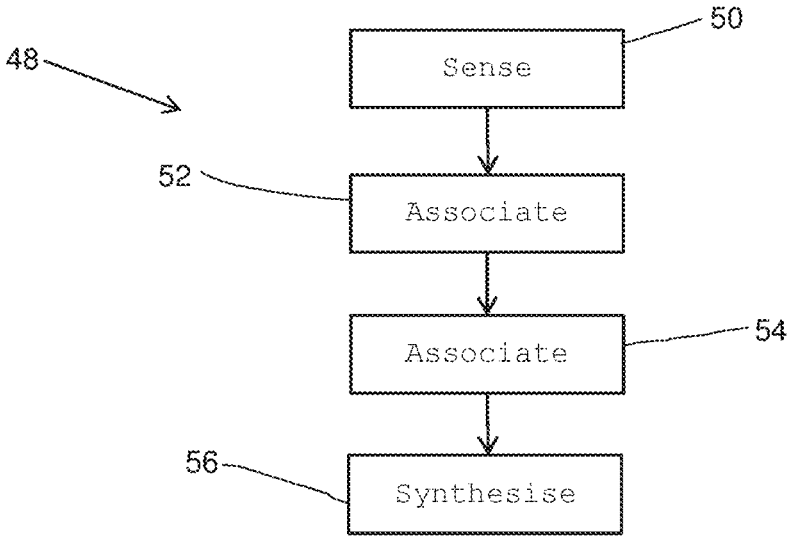
FIG. 2 is a diagrammatic representation of steps comprising an electrophonic chordophone method in accordance with one aspect of the invention.

With reference now to FIG. 2 of the accompanying drawings, there is shown an associated computer-implemented electrophonic chordophone method 48. The method 48 generally comprises the steps of sensing respective strings of the guitar 22 (indicated by process step 50), associating a melody group of notes producible by the strings with the first tonal format 28 in a direct correlation (indicated by process step 52), as well as associating a control group of notes producible by the strings with the second tonal format in an indirect correlation (indicated by process step 54).

The method 48 further includes the step of, in response to actuation of the strings, synthesising both the first and second tonal formats 28 and 30 simultaneously in substantial real-time (indicated by process step 56). As before, the first tonal format 28 is actuatable via the melody group of notes, and the second tonal format 30 is dynamically selectable via the control group of notes and actuatable via the melody group of notes. In this manner, a melody is producible via the first tonal format 28 and a dynamic backing track via the second tonal format 30.

It is to be appreciated that the step of sensing 50 is generally performed by means of a transducer configured to capture mechanical vibrations from the strings and convert same to an electrical signal.

In one example, both steps of associating the melody group and control group 52 and 54 are performed by means of the processor 32 executing a suitable software application. Similarly, the step of synthesising 56 is typically performed by means of the synthesiser 34, as described above.

Figure 3:
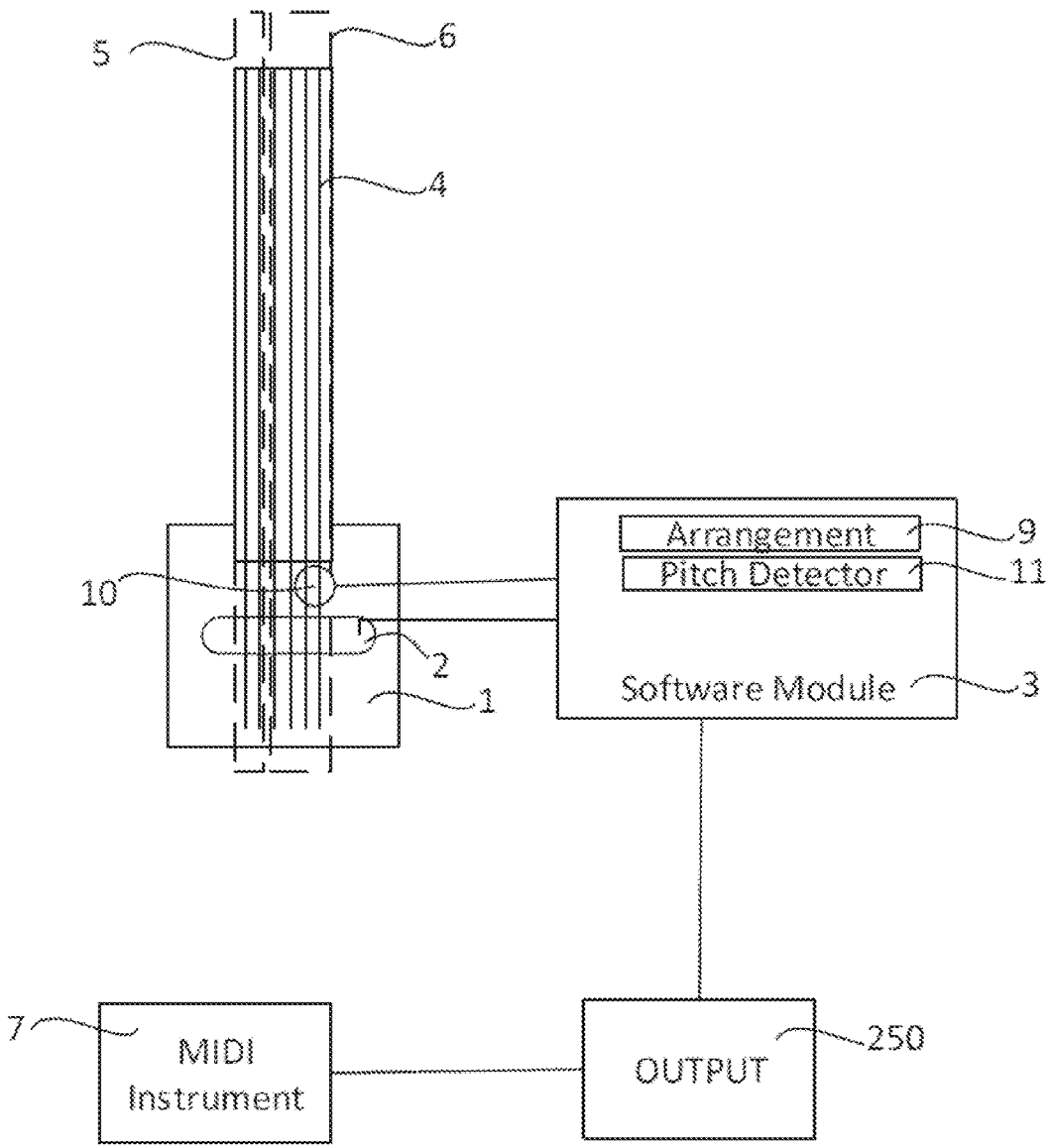
FIG. 3 is a diagrammatic representation of a specific example of the electrophonic chordophone system of FIG. 1.
Figure 4:
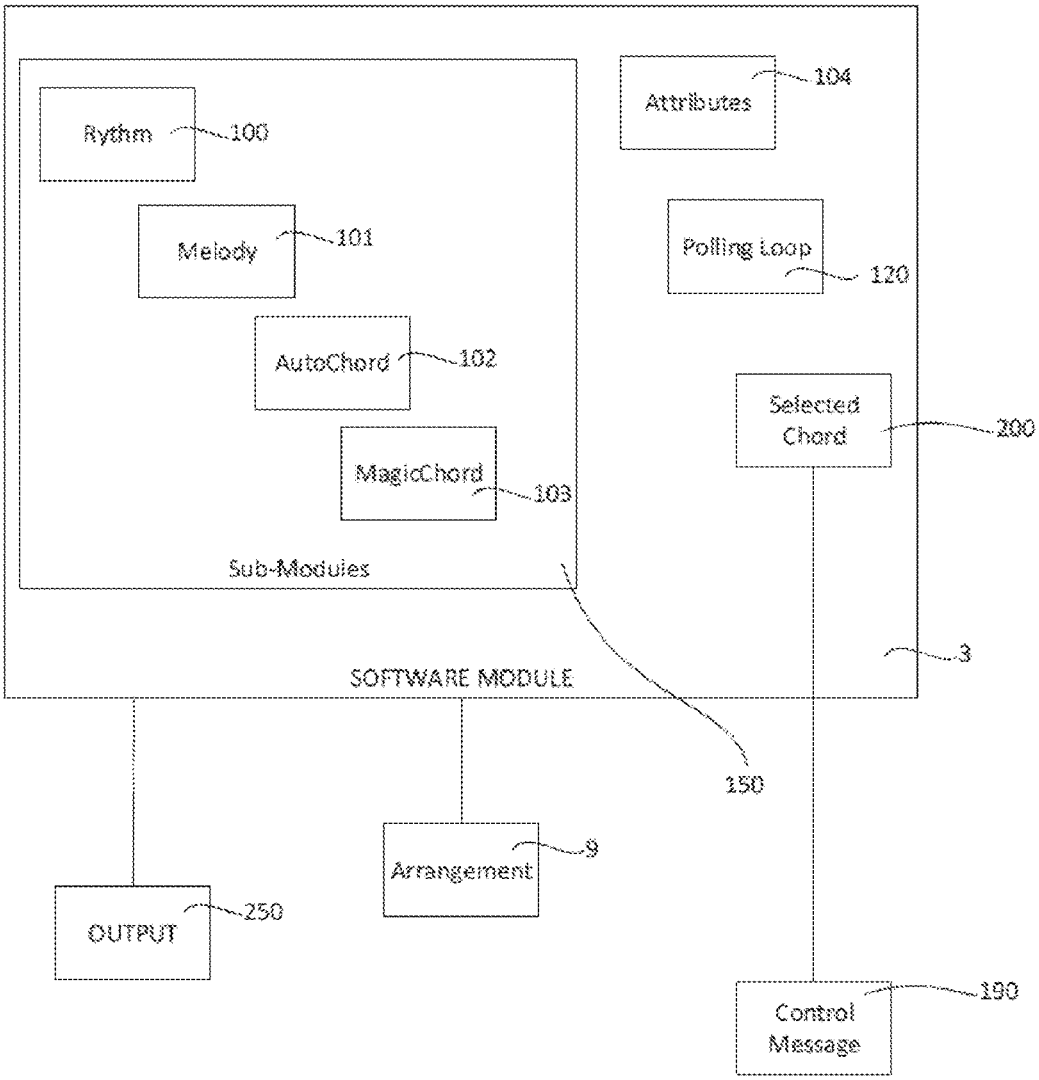
FIG. 4 is a diagrammatic representation of a specific example of the electrophonic chordophone apparatus of FIG. 1.

With reference now to FIGS. 3 and 4 of the accompanying drawings, particular examples of the system 20 and apparatus 40 are provided.

In this example, guitar 1 and MIDI instrument 7 are generally prior art known to those of ordinary skill in musical instruments. Software module 3 is configured to firstly receive source musical notes from an input 42, and in the context of FIG. 3, guitar 1 represents said input. Secondly, software module 3 processes said source musical notes using data extracted from arrangement 9 in order for software module 3 to correspondingly create output 250. Thirdly, software module 3 transmits output 250 to MIDI instrument 7 such that melodic and rhythmic sounds emanate from MIDI instrument 7.

As mentioned, guitar 1 is an example of an input. In this example, input means a stringed instrument having at least either an ability to convey an analogue signal to software module 3, or an ability to convey MIDI messages to software module 3.

FIG. 3 depicts guitar 1 comprising both MIDI pickup 2 and electromagnetic pickup 10 for the purposes of demonstrating two example of the present embodiment. If MIDI pickup 2 is connected to software module 3, then electromagnetic pickup 10 is generally not connected to software module 3. Conversely, if electromagnetic pickup 10 is connected to software module 3, then MIDI pickup 2 is generally not connected to software module 3.

In general, one embodiment is formed with guitar 1 comprising MIDI pickup 2 subsequently connected to software module 3 which is subsequently connected to MIDI instrument 7. A second embodiment is formed with guitar 1 comprising electromagnetic pickup 10 subsequently connected to software module 3 which is subsequently connected to MIDI instrument 7.

In the first embodiment, software module 3 receives MIDI messages from MIDI pickup 2 which are used by internal processes in software module 3. In the second embodiment, software module 3 receives an analogue signal from electromagnetic pickup 10 which pitch detector 11 converts to MIDI messages which are used by internal processes in software module 3.

Guitar 1 comprises strings 4. Any musical note arising from strings 4 being plucked is said to be a plucked note. Strings 4 are now divided into two groups, firstly being a control group 5 and secondly a melody group 6, i.e. the melody group notes and the control group notes. Any plucked note occurring from control group 5 is said to be a control message. Any plucked note occurring from melody group is said to be a melody message. Software module 3 is generally configured to only respond to a control message, meaning a control message is processed by software module 3, whilst software module 3 disregards melody message.

The purpose of MIDI pickup 2 is to translate plucked notes into MIDI messages and transmit them to software module 3. The purpose of electromagnetic pickup 10 is to convey a monophonic analogue signal to software module 3, wherein, pitch detector 11 converts said analogue signal to a frequency expressed in hertz which is subsequently converted into a MIDI note message having note identification in the range of 0 to 127.

Electromagnetic pickup senses at least one string 4. Said at least one string 4 sensed by electromagnetic pickup 10 means that said at least one string 4 can be comprised by control group 5 and can subsequently give rise to a control message.

Output 250 is formed by software module 3 by continuously drawing MIDI messages from arrangement 9 and manipulating said MIDI messages from arrangement 9 in accordance with control message and correspondingly output 250 is a collection of MIDI messages.

Typically, output 250 is a collection of MIDI messages repeatedly formed momentarily in a polling loop subsequent to being transmitted to MIDI instrument 7. If output 250 were observed just prior to being transmitted to MIDI instrument 7, then multiple MIDI messages would be found to encode melodic and rhythmic MIDI note on and MIDI note off events which in turn operate MIDI instrument 7.

In this example, software module 3 can be realised as a conventional MIDI sequencer and output 250 can be realised as a dynamic collection of MIDI messages correspondingly forming a MIDI sequence.

A distinguishing feature of the present invention is that software module 3 can be controlled with a single string pluck causing output 250 to be formed in accordance with a pre-set musical style encoded in arrangement 9. Where said string pluck represent notes of differing pitch, output 250 is heard to comprise chord changes corresponding to said notes of differing pitch, and in this way software module 3 effects an ability for a performer to control an entire band formed from synthesized instruments.

In summary, FIG. 3 shows an input embodied by guitar 1 connected to software module 3 such that control messages and melody messages are receivable by software module 3. Software module 3, through use of a polling loop, continuously derives and manipulates information from arrangement 9 in response to control message, in order to form output 250, which is subsequently transmitted to MIDI instrument 7, causing MIDI instrument 7 to emit sound.

Referring now to FIG. 4, there is shown an embodiment of software module 3 which comprises control parameters referred to as attributes 104. Attributes 104 are populated both with data from arrangement 9 and data gathered from a user. Attributes 104, when loaded from arrangement 9, can generally be modified by a user.

Attributes 104 typically comprise tempo, voice patches assigned to MIDI output channels, number of notes per chord, chord type and a key and scale, etc. Generally, tempo means beats per minute, voice patches means the timbres used to form sounds, number of notes per chord means how many individual notes occur when a chord is sounded whereby a chord of C major can comprise at least 3 notes voiced across multiple octaves, chord type means triad, seventh and ninth or any other musically valid chord formula, and key and scale mean a tonic and scale formula from which notes, chords and modes are derived.

MIDI output channels, voice patches, tempo, chords, triads, seventh, ninth, chord formula, modes, scales, key, octave and tonic are all terms known to one of ordinary skill.

If control message 190 encodes a note of C, and attributes 104 indicate the key of C major, a performer would expect software module 3 to assign selected chord 200 a chord value of C major. Additionally, if control message 190 encodes a note of D, selected chord 200 would correspondingly be assigned a value of D minor. As such, software module 3 automatically assigns a correct chord, according to a scale degree encoded as a note in control message 190, where correct chord is determined based upon information encoded in attributes 104.

Selected chord 200 is a software variable comprised by software module 3 which is subsequently used as a control parameter for sub-modules 150. Sub-modules 150 comprise a collection of processing logic exemplified by rhythm 100, melody 101, autochord 102 and MagicChord 103 functions. The minimal characteristics of any logic comprised by sub-modules 150 are firstly the ability to examine the present value of selected chord 200 and the values of attributes 104 and secondly to output MIDI messages which are harmonically related to either chord 200 or values encoded in attributes 104.

Polling loop 120, comprised by software module 3, periodically triggers sub-modules 150, where polling loop 120 is realised by one of ordinary skill to be a system timer common to software development languages. Trigger means that sub-modules 120 has an opportunity, several times per second, to analyse selected chord 200 and attributes 104 and can make a determination also based on data extracted from arrangement 9 as to whether or not to emit MIDI note on and MIDI note off messages having a harmonically correct pitch and occurring at a point in time determined by arrangement 9.

For example, if arrangement 9 encodes the musical style of waltz then arrangement 9 could inform rhythm 100 to trigger a kick drum on every first beat of a bar and a hi-hat on every second and third beat of a bar.

Arrangement 9 generally comprises data which, in the field of Digital Audio Workstations (DAW), forms a step sequence. Said step sequence is a common method of encoding musical events which are read and interpreted before output by a step sequencer.

Output 250 depicts the collective output of sub-modules 150 as each polling loop 120 event occurs, therefore as polling loop 120 triggers, sub-modules 150 correspondingly emits a collection of MIDI messages to be transmitted to MIDI instrument 7.

Rhythm aspect 100 generally output MIDI messages comprised by Output 250 which are read from arrangement 9 and by varying arrangement 9, rhythm 100 is correspondingly caused to output different styles of rhythm.

Melody aspect 101 generally extracts notes from selected chord 200 in order that notes can be duplicated, transposed and harmonized in order to dynamically create melody parts that are melodically correct in the context of selected chord 200. For example, melody 101 could output notes of C E G where selected chord 200 is assigned a value of C major and said notes of C E G are output in sequence with a time delay between each said note C E G such that MIDI instrument 7 emits a melody corresponding to the first, third and fifth scale degrees of the scale of C major.

Autochord aspect 102 generally outputs selected chord 200 with an enhanced voicing, meaning that multiple notes are voiced across a number of octaves extending the harmonic range of chords formulated by autochord 102.

Magicchord aspect 103 generally reads names of chords from arrangement 9 in the same aforementioned style of step sequence. For example, sequential steps assigned to magicchord 103 from arrangement 9 can convey a sequence of chords such as C major, A minor and G major in turn.

Autochord aspect 102 differs in purpose to magicchord 103 insofar as autochord 102 is driven by the value assigned to selected chord 200, which is correspondingly driven by input from control message 190 which arises from actions from a musical performer. Conversely magicchord 103 outputs chords defined by arrangement 9 and therefore outputs predefined chords regardless of the value assigned to selected chord 200.

Elaborating further on arrangement 9, aspects of MIDI events including velocity and event time are stored such that the volume level of MIDI events, being notes, can be encoded, replayed but also randomly varied to a degree in order to humanize a performance, meaning that step sequence sounds less quantized.

Arrangement 9 also typically comprises short step sequences equivalent to a small number of measures, for example 2 bars, which in common time is 8 beats. It is an aspect therefore of software module 3 to use arrangement 9 as a source of loops. Loops are known in the art of DAW to be building blocks of electronic music and when used repeatedly can rapidly lead to construction of musical passages. Loops are collections of MIDI messages as opposed to digitized sound samples.

Software module 3 generally coordinates the formation of collections of MIDI messages arising from processes executed in sub-modules 150, whereby said collections of MIDI messages are gathered into output 250 and subsequently fed to MIDI instrument 7 resulting in the output of a backing track in accordance with selected chord 200 which governs the tonality of MIDI messages generated by software module 3.

Software module 3 generally responds substantially instantaneously to changes in assigned values of selected chord 200 and by doing so, differs significantly from a pre-recorded backing track. Software module 3 also outputs MIDI messages through MIDI instrument 7 using timbres defined in arrangement 9 only for notes arising from control events and in doing so, by not responding to melody events, differs substantially from software associated with prior art that enables a guitar to simply transmit MIDI notes verbatim to a connected MIDI instrument where MIDI events arise from every note played on every string of a guitar.

Applicant believes it particularly advantageous that the present invention enables a user to activate/deactivate the second tonal format without interrupting the natural action of strumming a guitar. This allows, for example, the ability to make a backing track sound different in a chorus than in a verse.

Via the control group notes, it is possible to turn aspects of a backing track on or off by monitoring how the user strums the strings to create a distinction between a chorus and a verse, enriching the whole experience.

Optional embodiments of the present invention may also be said to broadly consist in the parts, elements and features referred to or indicated herein, individually or collectively, in any or all combinations of two or more of the parts, elements or features, and wherein specific integers are mentioned herein which have known equivalents in the art to which the invention relates, such known equivalents are deemed to be incorporated herein as if individually set forth.

It is to be appreciated that reference to "one example" or "an example" of the invention is not made in an exclusive sense. Accordingly, one example may exemplify certain aspects of the invention, whilst other aspects are exemplified in a different example. These examples are intended to assist the skilled person in performing the invention and are not intended to limit the overall scope of the invention in any way unless the context clearly indicates otherwise.

It is to be understood that the terminology employed above is for the purpose of description and should not be regarded as limiting. The described embodiment is intended to be illustrative of the invention, without limiting the scope thereof. The invention is capable of being practised with various modifications and additions as will readily occur to those skilled in the art.

Various substantially and specifically practical and useful exemplary embodiments of the claimed subject matter are described herein, textually and/or graphically, including the best mode, if any, known to the inventors for carrying out the claimed subject matter. Variations (e.g. modifications and/or enhancements) of one or more embodiments described herein might become apparent to those of ordinary skill in the art upon reading this application.

The inventor(s) expects skilled artisans to employ such variations as appropriate, and the inventor(s) intends for the claimed subject matter to be practiced other than as specifically described herein. Accordingly, as permitted by law, the claimed subject matter includes and covers all equivalents of the claimed subject matter and all improvements to the claimed subject matter. Moreover, every combination of the above described elements, activities, and all possible variations thereof are encompassed by the claimed subject matter unless otherwise clearly indicated herein, clearly and specifically disclaimed, or otherwise clearly contradicted by context.

The use of any and all examples, or exemplary language (e.g., "such as") provided herein, is intended merely to better illuminate one or more embodiments and does not pose a limitation on the scope of any claimed subject matter unless otherwise stated. No language in the specification should be construed as indicating any non-claimed subject matter as essential to the practice of the claimed subject matter.

The use of words that indicate orientation or direction of travel is not to be considered limiting. Thus, words such as "front", "back", "rear", "side", "up", down", "upper", "lower", "top", "bottom", "forwards", "backwards", "towards", "distal", "proximal", "in", "out" and synonyms, antonyms and derivatives thereof have been selected for convenience only, unless the context indicates otherwise. The inventor(s) envisage that various exemplary embodiments of the claimed subject matter can be supplied in any particular orientation and the claimed subject matter is intended to include such orientations.

The use of the terms "a", "an", "said", "the", and/or similar referents in the context of describing various embodiments (especially in the context of the claimed subject matter) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted.

Accordingly, every portion (e.g., title, field, background, summary, description, abstract, drawing figure, etc.) of this application, other than the claims themselves, is to be regarded as illustrative in nature, and not as restrictive; and the scope of subject matter protected by any patent that issues based on this application is defined only by the claims of that patent.

The invention claimed is:

1. An electrophonic chordophone system comprising:

a sensor operatively responsive to respective strings of a guitar;

non-transitory processor-readable storage means containing first and second user-configurable tonal formats;

a processor arranged in signal communication with the sensor and storage means, said processor adaptable to:

i) allow a user to associate a melody group of notes producible by the strings with the first tonal format in a one-to-one mapping, and ii) allow the user to associate a control group of notes producible by the strings with the second tonal format in a one-to-many mapping, said control group forming a subset of the melody group; and a synthesiser arranged in signal communication with the processor, said synthesiser configured to produce both the first and second tonal formats simultaneously in substantial real-time, the first tonal format actuatable via the melody group of notes and the second tonal format dynamically selectable via the control group of notes and actuatable via the melody group of notes, so that a melody is producible via the first tonal format and a dynamic backing track, independent of the melody, comprising multiple timbres is producible via the second tonal format.

2. The system of claim 1, wherein the first tonal format comprises a collection of notes.

3. The system of claim 2, wherein the second tonal format comprises a collection of at least one of chords and timbres.

4. The system of the claim 1, wherein the sensor comprises a transducer configured to capture mechanical vibrations from the strings and convert same to an electrical signal.

5. The system of claim 1, wherein the sensor is configured to digitise analogue notes produced by the strings.

6. The system of claim 1, wherein the processor is configured to digitise analogue notes produced by the strings.

7. The system of claim 1, wherein the first and second tonal formats are user-configurable by means of a software application executed by the processor.

8. The system of claim 1, wherein the notes comprising the melody group of notes and the notes comprising the control group are user-configurable by means of a software application executed by the processor.

9. The system of claim 1, wherein the processor is adapted to associate the melody group of notes and the control group of notes by means of a software application executed by the processor.

10. The system of claim 1, wherein the synthesiser comprises an electronic musical instrument that converts electric signals to sound.

11. The system of claim 1, wherein the synthesiser includes at least one speaker.

12. An electrophonic chordophone apparatus comprising:

an input for receiving notes produced by strings of a guitar;

non-transitory processor-readable storage means containing first and second user-configurable tonal formats;

a processor arranged in signal communication with the input and storage means; and an output whereby the processor is able to output signals to a synthesiser;

wherein the processor is adapted to:

(i) associate a melody group of notes producible by the strings with the first tonal format in a one-to-one mapping, (ii) associate a control group of notes producible by the strings with the second tonal format in an one-to-many mapping, said control group forming a subset of the melody group, and (iii) output, to the synthesiser, both the first and second tonal formats simultaneously in substantial real-time, the first tonal format actuatable via the melody group of notes and the second tonal format dynamically selectable via the control group of notes and actuatable via the melody group of notes, so that a melody is producible by the synthesiser via the first tonal format and a dynamic backing track, independent of the melody, comprising multiple timbres is producible via the second tonal format.

13. The apparatus of claim 12, wherein the input includes a transducer configured to capture mechanical vibrations from the strings and convert same to an electrical signal.

14. The apparatus of claim 12, wherein the input is configured to digitise analogue notes produced by the strings.

15. The apparatus of claim 12, wherein the processor is configured to digitise analogue notes produced by the strings.

16. The apparatus of claim 12, wherein the first and second tonal formats are user-configurable by means of a software application executed by the processor.

17. The apparatus of claim 12, wherein the notes comprising the melody group of notes and the notes comprising the control group of notes are user-configurable by means of a software application executed by the processor.

18. A computer-implemented electrophonic chordophone method comprising the steps of:

sensing respective strings of a guitar;

associating a melody group of notes producible by the strings with a first tonal format in a one-to-one mapping;

associating a control group of notes producible by the strings with a second tonal format in a one-to-many mapping, said control group forming a subset of the melody group; and in response to actuation of the strings, synthesising both the first and second tonal formats simultaneously in substantial real-time, the first tonal format actuatable via the melody group of notes and the second tonal format dynamically selectable via the control group of notes and actuatable via the melody group of notes, so that a melody is produced via the first tonal format and a dynamic backing track, independent of the melody, comprising multiple timbres is producible via the second tonal format.

19. The method of claim 18, wherein the first tonal format comprises a collection of notes.

20. The method of claim 18, wherein the second tonal format comprises a collection of at least one of chords and timbres.

* * * * *